US005891198A

United States Patent [19]

Pearlstein

[11] Patent Number: 5,891,198

[45] Date of Patent: Apr. 6, 1999

[54] FABRIC CLEANING METHOD AND SYSTEM

[76] Inventor: Dennis L. Pearlstein, 8130 W. Walker Dr., Littleton, Colo. 80123

[21] Appl. No.: 898,668

[22] Filed: Jul. 22, 1997

Related U.S. Application Data

[60] Provisional application No. 60/023,269 Jul. 24, 1996.

[51] Int. Cl.[6] ..... D06B 1/02

[52] U.S. Cl. ..... 8/158; 15/322

[58] Field of Search ..... 8/158; 15/321, 15/322

[56] References Cited

U.S. PATENT DOCUMENTS

| | | | |
|---|---|---|---|
| 2,960,710 | 11/1960 | McKeegan | 15/321 X |
| 3,262,146 | 7/1966 | Hays . | |
| 3,332,101 | 7/1967 | Leinfelt et al. | 15/321 |
| 4,075,733 | 2/1978 | Parise et al. | 15/322 |
| 4,329,756 | 5/1982 | Chicoine et al. | 15/322 X |
| 4,654,925 | 4/1987 | Grave . | |
| 4,872,920 | 10/1989 | Elynn et al. . | |
| 4,926,514 | 5/1990 | Lewenberger . | |
| 4,974,618 | 12/1990 | Nystead . | |
| 4,998,317 | 3/1991 | Passien . | |
| 5,075,921 | 12/1991 | Gleadall . | |
| 5,099,543 | 3/1992 | Wable . | |
| 5,113,547 | 5/1992 | Mayhew . | |
| 5,157,805 | 10/1992 | Pinter . | |
| 5,413,808 | 5/1995 | Wuner . | |
| 5,503,594 | 4/1996 | Karubian et al. . | |
| 5,752,289 | 5/1998 | Collins | 15/322 X |

FOREIGN PATENT DOCUMENTS

| | | |
|---|---|---|
| 2145620 | 4/1985 | United Kingdom . |

*Primary Examiner*—Philip R. Coe
*Attorney, Agent, or Firm*—Brian D. Smith, P.C.

[57] ABSTRACT

A system for cleaning fabric-like surfaces, such as carpet, fabric, upholstery, and the like is disclosed. The system includes a Y-type connector for receiving and mixing pressurized air and pressurized cleaning solution to produce a mixture thereof. In addition, the system includes a nozzle in communication with the Y-type connector for atomizing the mixture to produce atomized cleaning solution, which is sprayed onto a fabric-like surface to clean the surface. A supply source for supplying the Y-connector with pressurized cleaning solution is also provided, as well as a pressurized air source for supplying the Y-connector with pressurized air. In addition, the system includes a vacuum generating mechanism for generating suction to remove cleaning solution having been sprayed onto a fabric-like surface.

33 Claims, 2 Drawing Sheets

FABRIC CLEANING METHOD AND SYSTEM

CROSS REFERENCE TO RELATED APPLICATIONS

This application is a nonprovisional application claiming the benefit under 35 USC 119(e) of U.S. provisional application Ser. No. 60/023,269, filed on Jul. 24, 1996.

TECHNICAL FIELD OF THE INVENTION

The invention relates generally to methods and apparatus for cleaning fabric or fabric-like surfaces such as carpeting, fabric, upholstery and the like. More particularly, the invention relates to foamless methods and apparatus for cleaning such fabrics.

BACKGROUND OF THE INVENTION

U.S. Pat. No. 4,974,618 to Nysted discloses a method and apparatus for the foam cleaning of upholstery fabrics. The apparatus includes a generally hollow head having two foam mixing chambers in close proximity to a vacuum chamber. Foam is generated adjacent the fabric to be cleaned by admixing pressurized air and a liquid foam-producing agent in the two mixing chambers. The air pressure directs the foam from the second mixing chambers towards the fabric. Two screens are used to control the consistency and application of foam. Suction is simultaneously provided in the vacuum chamber so that the foam is rapidly and continuously recovered. A brush means is positioned between the second mixing chamber, and the vacuum chamber to further agitate the foam and fabric to be cleaned, and to help create a partial pressure when the moving foam is applied to the surface of a fabric.

While a foam cleaning method will clean fabrics, foam has its drawbacks in that it leaves a residue on the fabric which is difficult if not impossible to remove.

In addition to foam cleaning methods and apparatus, a method referred to as steam cleaning is also commonly employed to clean fabric and fabric-like surfaces, especially upholstery. As noted in the '618 patent to Nysted, U.S. Pat. No. 4,083,077 discloses that steam cleaning methods and apparatus typically employ a hand tool, which is associated with a steam cleaning machine, for cleaning carpets, as well as upholstery and other fabrics. The hand tool embodies a generally hollow head defining a cleaning agent chamber with a bottom opening, and a vacuum chamber with a bottom opening positioned forward of the cleaning agent chamber. The operator squeezes a trigger to release a cleaning fluid solution to the cleaning agent chamber where it is sprayed into the pile of the underlying fabric. As the operator pulls the hand tool in the direction of the cleaning agent chamber, suction from the vacuum chamber is applied to remove the moisture previously sprayed onto the fabric.

U.S. Pat. No. 4,654,925 to Grave discloses a type of steam cleaning machine for cleaning fabric and the like, which utilizes a nozzle structure comprising an arrangement of one or more jets for co-mixing air and cleaning fluid to cause the cleaning fluid to become reduced to very small particles for effective penetration of the surface material to be cleaned. The patent discloses that an air stream is drawn into the nozzle to engage the leading edge of the stream of cleaning fluid as it moves into engagement the surface to be cleaned. The air stream is indicated to have such force as to cause a deflection of the cleaning fluid stream so as to engage the surface to be cleaned at an angle to be, in effect, swept into and through the material to be cleaned in a continuous moving action, which is stated to leave very little residue of dampness in the cleaned area.

While it would appear that the aforementioned methods and apparatus disclose useful improvements in the art of fabric cleaning, further improvements are desired, particularly in methods and apparatus for simplifying and economically cleaning such surfaces.

SUMMARY OF THE INVENTION

The present invention addresses the limitations of the aforementioned prior art by providing a method, system and apparatus for cleaning fabric-like surfaces such as carpet, fabric, upholstery and the like. The system of the present invention includes atomizing means having nozzle means for mixing and processing pressurized air and pressurized cleaning solution to produce a substantially foamless atomized cleaning solution. The nozzle means is also provided to spray the atomized cleaning solution onto a fabric-like surface to clean the fabric-like surface. In addition, the system includes cleaning solution supply means for supplying the atomizing means with pressurized cleaning solution as well as air supply means for supplying the atomized means with pressurized air. Finally, vacuum means is provided for removing cleaning solution having been sprayed onto the fabric-like surface.

A preferred embodiment of the present invention utilizes a wand as that term is known to those skilled in the art which is held by an operator like a vacuum cleaner wand during operation. The wand has a hood-like head structure defining a first chamber having a bottom opening with the nozzle means disposed within the first chamber for spraying the foamless atomized cleaning solution onto a fabric-like surface through the bottom opening. The head structure also defines a vacuum chamber having bottom slot means adjacent the first chamber for generating suction to remove the cleaning solution from the fabric-like surface after it has been sprayed thereon. The vacuum chamber is in communication with a vacuum generating source for generating suction at the slot means to remove the cleaning solution after it has been sprayed on the fabric surface, as previously indicated.

A preferred method of the present invention for cleaning fabric as indicated, supplies pressurized air and pressurized cleaning solution to the atomizing means in the head structure of a wand such as that described above at predetermined pressures to atomize the cleaning solution without generating substantial amounts of foam. The method further includes spraying the fabric-like surface with the atomized cleaning solution, and removing it from the fabric-like surface immediately after it is sprayed thereon.

In a particularly preferred method of the present invention, the pressurized air and pressurized cleaning solutions are supplied to the atomizing means at pressures between about 90 and 120 psi.

In another preferred method of the present invention, the pressure of the pressurized air is controlled or adjusted to control the amount of cleaning solution sprayed onto the fabric-like surface. For example, by reducing the pressure of the pressurized air relative to that of the cleaning solution, more cleaning solution can be sprayed onto the fabric-like surface. This will result in more wetting of the surface being cleaned which may be desirable or necessary to effectively clean the surface if it is extremely dirty.

BRIEF DESCRIPTION OF DRAWINGS

The invention will be more readily understood by reference to the accompanying drawings wherein like reference numerals indicate like elements throughout the drawing figures, and in which:

FIG. 4 is a schematic of a system of the present invention which utilizes the wand of FIGS. 1–3 for cleaning fabric-like surfaces such as carpeting, fabric, upholstery and the like.

DETAILED DESCRIPTION OF PREFERRED EMBODIMENT

Figure 4:
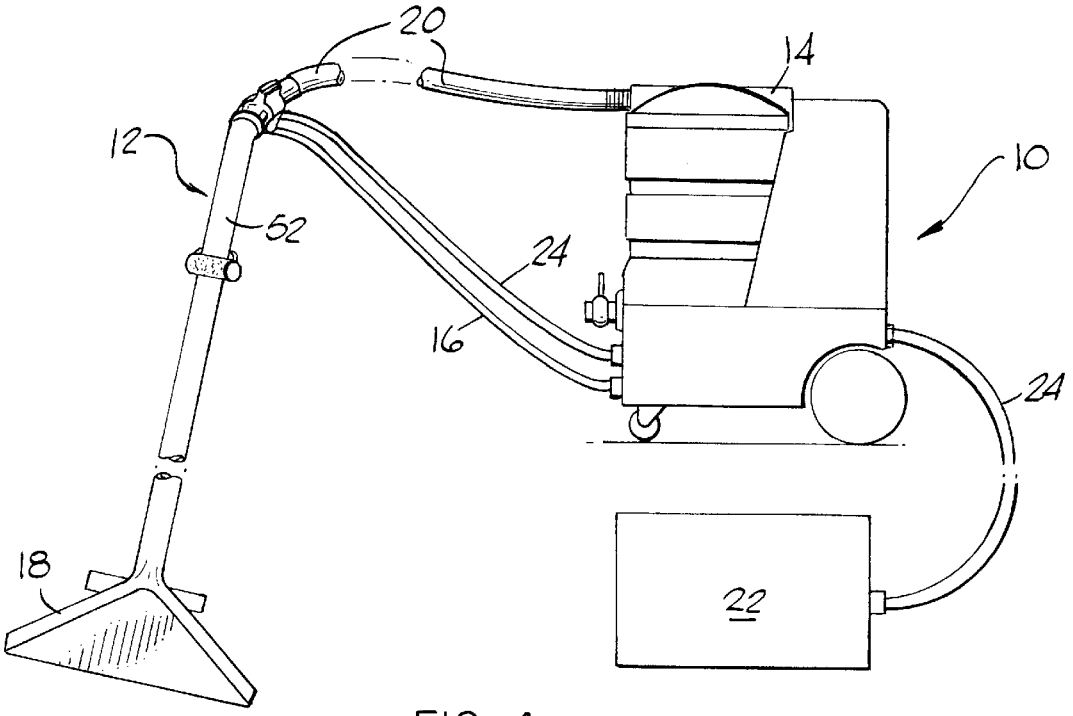

FIG. 4 illustrates a system 10 of the present invention for cleaning fabric-like surfaces such as carpeting, fabric, upholstery and the like. As shown, the system includes a cleaning wand 12 and a portable extractor 14 for supplying wand 12 with pressurized cleaning fluid via a hose or line 16. Extractor 14 also has means for generating a vacuum in a head structure 18 of wand 12 for returning or recycling dirty cleaning fluid to extractor 14 via a vacuum hose 20. As also shown, the system includes a compressor 22 for supplying wand 12 with pressurized air which is conveyed through extractor 14 via an air hose or line 24, as explained in more detail below.

Portable extractors, similar to extractor 14, are commercially available and known to those skilled in the art. A commercially available portable extractor which is suitable for use in the present invention when modified in accordance with the present invention to convey pressurized air as discussed above is manufactured by Century 400 of Pueblo, Colorado, and sold under the trademark Ninja, Model No. 500-04B. A compressor 22 which is suitable for use in the present invention may be any portable compressor which is capable of generating the necessary pressures as discussed below. A two horse-power compressor will generally provide good results, such as that available and manufactured by Thomas Industries, Inc. of Sheboygan, Wis., Model Number T-2820ST.

Figure 2:
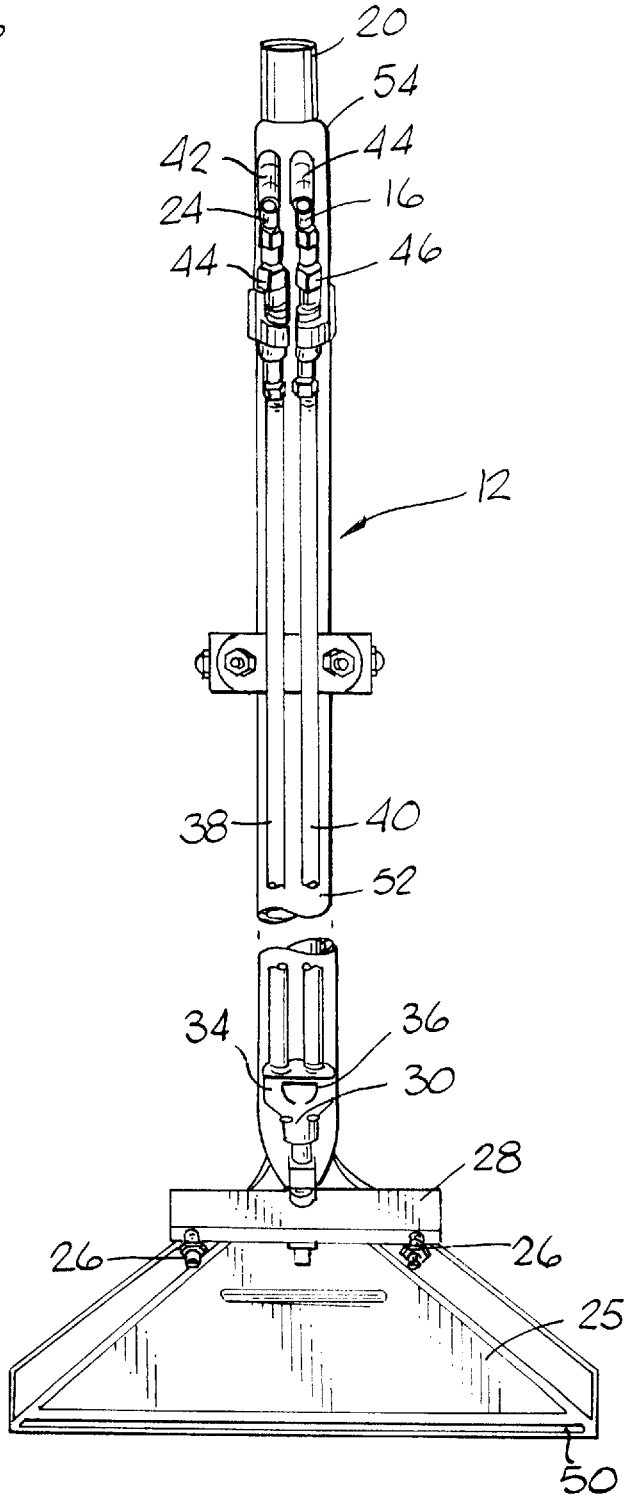
FIG. 2 is a bottom plan view of the wand of FIG. 1.

The head structure 18 of wand 12 is identified in more detail in FIG. 2, and as shown therein, head structure 18 is generally hood-like shaped, and provided such that it defines a first chamber 25 having a bottom opening (not numbered) with nozzle means, which as shown is a pair of nozzles 26, mounted therein.

Figure 3:
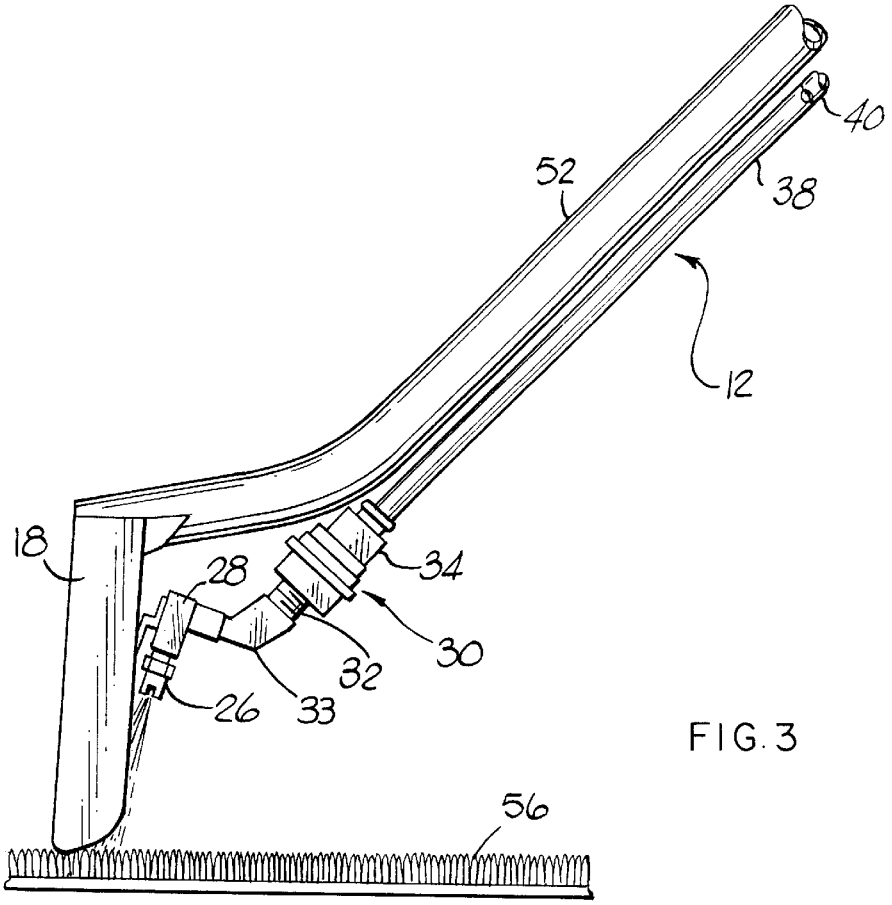
FIG. 3 is an enlarged partial view of the head-like structure of the wand of FIG. 1.

As also shown in FIGS. 2 and 3, nozzles 26 are mounted and in fluid communication with a manifold 28 which, in turn, is in fluid communication with an outlet 32 of a Y-connector 30 via a 45 degree street elbow brass fitting 33. As also shown, Y-connector 30 is provided with a pair of inlets 34 and 36 which are in communication with Nylon tubing or hoses 38, 40, respectively, which supply Y-connector 30 with pressurized air, and pressurized cleaning solution, respectively.

Figure 1:
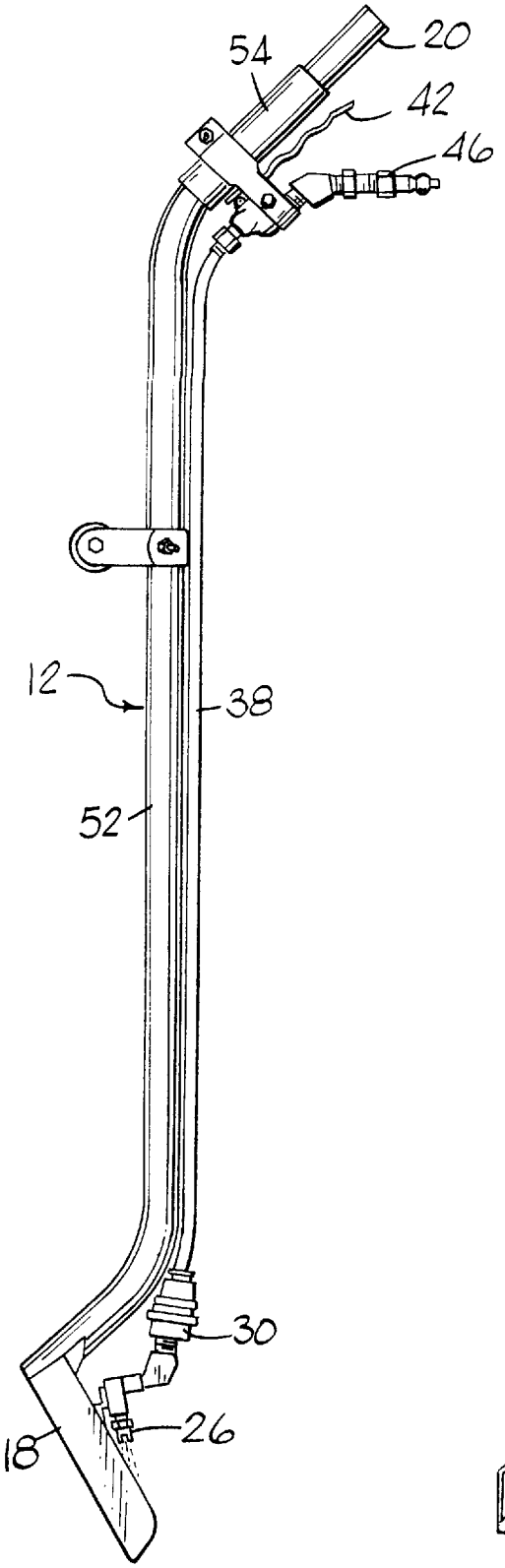
FIG. 1 is a side elevational view of a cleaning wand of the present invention for applying atomized cleaning solution to a fabric-like surface.

Continuing with FIGS. 1 and 2, it will be appreciated that hoses 38 and 40 are each connected to trigger means identified respectively as triggers 42, 44 for controlling the supply of fluid, i.e. pressurized cleaning fluid and/or pressurized air, through its respective hose. As also shown, each trigger mechanism 42, 44 is provided with a hose fitting 46 for attaching the triggers to their respective hoses 16, 24 which supply wand 12 with pressurized air and pressurized cleaning solution, as previously described.

As previously mentioned, the pressurized air is supplied by compressor 22 which conveys it to wand 12 through hose 24 which passes through extractor 14. There is no technical reason for passing hose 24 through the extractor. However, this allows hose 24 to be positioned next to hose 16 at the point they exit extractor 14. This positioning of the hoses in close proximity to each other makes it less likely for an operator to catch the hoses on something as the operator moves the wand on the surface being cleaned during operation.

Returning now to FIGS. 2 and 3, it will be appreciated that head structure 18 also defines a vacuum chamber (not shown) having a bottom slot 50. The vacuum chamber is in communication with the vacuum generating means provided in extractor 14 via a conduit 52 of wand 12, and vacuum hose 20 which is attached to conduit 52 by a connector 54. As those skilled in the art will appreciate, suction is generated at slot 50 by the vacuum generating means which serves to remove dirty cleaning solution after it has been sprayed via nozzles 26 onto a fabric-like surface such as the carpeting 56 illustrated in FIG. 3. The dirt in the cleaning solution is removed therefrom by extractor 14 in a manner which is well known to those skilled in the art, and which forms no part of the present invention.

An important aspect of the present invention is the system's ability to atomize the cleaning solution to provide a generally foamless atomized spray which has been found to be highly effective in dislodging dirt and other particles from a fabric-like surface to be cleaned by the system. Atomization of the cleaning solution has also been found to substantially reduce or prevent over wetting of the fabric-like surface because it atomizes the solution into extremely fine particles which are capable of being quickly removed from the carpeting by the suction generated at the vacuum slot 50 of the wand's head.

Effective atomization of the cleaning solution is provided in accordance with the present invention by not only properly pressurizing the air and cleaning fluid as described below but also by properly mixing the pressurized air and pressurized cleaning solution before they are passed through an atomizing nozzle means, such as nozzles 26. In the illustrated embodiment, it has been found that Y-connector 30, which receives the sources of pressurized air and pressurized cleaning fluid through its respective inlets 34, 36, provides effective mixing of the pressurized air and pressurized cleaning fluids. Other intake means such as the more expensive air atomizing nozzles available from Spraying Systems Co. of Wheaton, Ill. which have built-in air/fluid mixing chambers are considered to be within the scope of the present invention.

Atomization is also affected by the type of nozzle used in the system. Spray nozzles used in the illustrated embodiment (which technically are not atomizing nozzles having built-in air/fluid mixing chambers as discussed above) and which have been found to provide effective atomization when used in conjunction with Y-connector 30 as discussed above are available from Spraying Systems Co. of Wheaton, Ill. under the trademark VeeJet, Model No. H-VV. The nozzle used in the illustrated embodiment and providing good results had a 110 degree spray pattern at 40 psi and a No. 5 opening or orifice designated by the number 11005.

In addition to nozzle selection and mixing of the pressurized air and cleaning solution, it has been found that effective atomization is not possible unless both the pressurized cleaning solution and the source of pressurized air are properly pressurized. In a preferred embodiment of the present invention, it has been found that effective atomization is achieved producing extremely fine droplets when the pressurized air and pressurized cleaning solutions are pressurized similarly, i.e., to similar pressures in a generally one-to-one ratio. Thus, if the cleaning solution is pressurized to 100 psi, the air supplied by compressor 22 is preferably pressurized to 100 psi. The fine particles produced by atomizing at the aforementioned pressures have been found to very effectively dislodge dirt from carpeting sprayed with the atomized solution.

As also previously mentioned, if it is desired to produce a "wetter" spray to clean a particularly dirty surface, such is easily provided in accordance with the present invention by simply reducing the pressure of the air relative to that of the cleaning solution. This is done easily in accordance with the present invention by simply adjusting a knob (not shown) on air compressor 22 until the spray has the desired degree of wetness.

While pressure ranges around 100 psi are preferred for general use, it has been found that satisfactory results are possible with cleaning solutions pressurized to a pressure anywhere between about 50 and 250 psi. Typically, however, the cleaning solution will be pressurized to a pressure between about 75 and 225 psi, and as previously mentioned, to a pressure of between about 90 and 200 psi. Similarly, the air may be pressurized to a range of anywhere between about 25 and 175 psi as long as it does not exceed the pressure of the cleaning solution. The air pressure should not exceed the pressure of the cleaning solution since it will, in effect, cut off the supply of pressurized cleaning fluid. Typically, the pressure of the air will be controlled to be somewhere between about 60 and 140 psi, as previously mentioned, preferably between about 90 and 120 psi. If an extremely wet spray is desired, the air pressure may be reduced to as little as about 25 percent of that of the cleaning solution.

As those skilled in the art will appreciate, to properly clean a desired fabric-like surface, the system is preferably operated continuously for a period of time which is sufficient to clean a desired area. Accordingly, it will be appreciated that the atomizing means must be continuously supplied with the necessary pressurized air, and pressurized cleaning solution, to continuously atomize the cleaning solution, which, of course, is continuously sprayed on the fabric-like surface being cleaned, and continuously and immediately removed from the fabric-like surface after it is sprayed thereon by the suction generated at slot 50 by the vacuum means of extractor 14, as previously described.

In accordance with another important aspect of the present invention, the preferred cleaning solution consists essentially of water with perhaps a small amount of cleaner or conditioner added to the water. Water has not only been found to provide good cleaning but it does not foam. As previously mentioned, foam is undesirable because it leaves a residue on the fabric which is difficult if not impossible to remove.

Those skilled in the art will also appreciate the fact that the head 18 of wand 12 is not provided with a brush or brush-like means for scrubbing the carpeting or other fabric-like surface being cleaned. It has been found that a brush-like means, which in other cleaning systems is typically positioned between the spray generated by the spray nozzle and the vacuum slot, is not necessary since the atomized spray provided by the present invention is apparently all that is needed to dislodge dirt from the surface of the fabric being cleaned.

Those skilled in the art will also appreciate the fact that on-off triggers 42 and 44 for respectively controlling the supply of pressurized and pressurized cleaning fluid are disposed in a side-by-side relationship with respect to each other so that they can be actuated by an operator with one hand.

Wand 12 of the present invention, while modified in accordance with the present invention, is quite similar to conventional wands such as those available from Production Metal Forming, Inc. of Kalamath Falls, Oreg. The wand illustrated in the drawings, which was modified in accordance with the present invention, is sold under the trademark Low Boy, Model No. W15512.

Nylon tubing, ⅜ inch ID, which is available from the Parker Hannifin Corporation of Otsego, Mich. is preferred for use as hoses 38, 40, as well as hoses 16, 24 Triggers 42, 44 are also available from Production Metal Forming, Inc., and identified by Model No. V-300.

Compressor 22, as previously mentioned, is a Model No. T-2820 sold under the trademark Air-Pac by Thomas Industries, Inc. of Sheboygan, Wis.

Y-connector 30 shown in the figures is an adjustable male Y-connector, Model No. W368PL-6-4 which is available from Parker Hannifin of Otsego, Mich.

The invention has been described in detail with reference to a particular embodiment thereof, but it will be understood that various other modifications can be effected within the spirit and scope of this invention.

I claim:

1. A system for cleaning a fabric-like surface such as carpet, fabric and upholstery, said system comprising:

atomizing means including nozzle means for mixing and processing pressurized air and pressurized cleaning solution to produce a substantially foamless atomized cleaning solution, said nozzle means also for spraying the atomized cleaning solution onto a fabric-like surface to clean the fabric-like surface;

cleaning solution supply means for supplying said atomizing means with pressurized cleaning solution;

air supply means for supplying said atomizing means with pressurized air; and vacuum means for removing the cleaning solution having been sprayed onto the fabric-like surface.

2. A system as claimed in claim 1 further comprising:

means for recycling the removed cleaning solution.

3. A system as claimed in claim 1 further comprising:

means for collecting and purifying the removed cleaning solution so that it can be re-supplied to said nozzle means for use again to clean fabric-like surfaces.

4. A system as claimed in claim 1 wherein said air supply means is capable of supplying said atomizing means with pressurized air at a pressure of between about 25 and 175 psi.

5. A system as claimed in claim 1 wherein said cleaning solution supply means is capable of supplying said atomizing means with pressurized cleaning solution at a pressure of between about 50 and 250 psi.

6. A system as claimed in claim 1 further comprising a hood-like head structure defining a first chamber having a bottom opening with said nozzle means being disposed within said first chamber for spraying the foamless atomized cleaning solution onto the fabric-like surface through said bottom opening and wherein said head structure also defines a vacuum chamber having bottom slot means adjacent said first chamber for generating suction to remove the cleaning solution from the fabric-like surface after it is sprayed thereon, said vacuum chamber being in communication with a vacuum generating source for generating the suction at said slot means and in said vacuum chamber.

7. A system as claimed in claim 1 wherein said air supply means includes an air compressor having means for controlling the pressure of the air supplied to said atomizing means.

8. A system as claimed in claim 1 wherein said cleaning solution supply means includes a portable extractor having means for controlling the pressure of the cleaning solution supplied to said atomizing means.

9. A system as claimed in claim 1 wherein said air supply means and said cleaning solution supply means each includes means for controlling the supply of its respective fluid to said atomizing means.

10. A system as claimed in claim 9 wherein each control means includes a hand actuated trigger for controlling the supply of its respective fluid to said atomizing means.

11. A system as claimed in claim 10 wherein said hand actuated triggers are disposed in a side by side relationship with respect to each other so that both triggers can be actuated with one hand.

12. A system a claimed in claim 1 wherein said nozzle means includes a plurality of nozzles and said atomizing means includes manifold means in communication with said plurality of nozzles for supplying said nozzles with the atomized cleaning solution.

13. A method of cleaning a fabric-like surface such as carpet, fabric and upholstery, said method comprising:

providing a system including:

atomizing means including nozzle means for mixing and processing pressurized air and pressurized cleaning solution to produce a substantially foamless atomized cleaning solution, said nozzle means also for spraying the foamless atomized cleaning solution onto a fabric-like surface to clean the fabric-like surface;

cleaning solution supply means for supplying said atomizing means with pressurized cleaning solution;

air supply means for supplying said atomizing means with pressurized air; and vacuum means adjacent said nozzle means for removing the cleaning solution having been sprayed onto the fabric-like surface;

supplying pressurized air and pressurized cleaning solution to the atomizing means at predetermined pressures respectively to atomize the cleaning solution without generating substantial amounts of foam;

spraying a fabric-like surface with the atomized cleaning solution; and removing the cleaning solution from the fabric-like surface immediately after it is sprayed thereon.

14. A method as claimed in claim 13 wherein the atomizing means is continuously supplied with the pressurized air and the pressurized cleaning solution to continuously atomize the cleaning solution which is continuously sprayed on the fabric-like surface and wherein the cleaning solution is continuously removed from the fabric-like surface immediately after it is sprayed thereon.

15. A method as claimed in claim 13 wherein the spraying and removing steps are carried out simultaneously such that the cleaning solution is removed from the fabric-like surface immediately after it is sprayed thereon.

16. A method as claimed in claim 13 wherein the spraying and removing steps are carried out simultaneously and continuously over a period of time which is sufficient to clean a desired area of fabric-like surface.

17. A method as claimed in claim 13 which is carried out without brushing the fabric-like surface.

18. A method as claimed in claim 13 wherein the pressurized air supplied by said air supply means has a pressure of between about 25 and 175 psi.

19. A method as claimed in claim 13 wherein the pressurized air supplied by said air supply means has a pressure of between about 60 and 140 psi.

20. A method as claimed in claim 13 wherein the pressurized air supplied by said air supply means has a pressure of between about 90 and 120 psi.

21. A method as claimed in claim 13 wherein the pressurized cleaning solution supplied by said cleaning solution supply means has a pressure of between about 50 and 250 psi.

22. A method as claimed in claim 13 wherein the pressurized cleaning solution supplied by said cleaning solution supply means has a pressure of between about 75 and 225 psi.

23. A method as claimed in claim 13 wherein the pressurized cleaning solution supplied by said cleaning solution supply means has a pressure of between about 90 and 200 psi.

24. A method as claimed in claim 13 wherein the pressurized air supplied by said air supply means has a pressure of between about 25 and 150 psi which is between about 25% and 100% of the pressure of the pressurized cleaning solution.

25. A method as claimed in claim 13 further comprising controlling the pressure of the pressurized air relative to the cleaning solution pressure to control the amount of cleaning solution being sprayed on the fabric-like surface.

26. A method as claimed in claim 25 wherein the pressure of the pressurized air is controlled so that it is between about 25% 100% of the pressure of the pressurized cleaning solution.

27. A method as claimed in claim 13 wherein both the pressurized air supplied by said air supply means and the pressurized cleaning solution supplied by said cleaning solution supply means have a pressure of between about 90 and 120 psi.

28. A method as claimed in claim 13 further comprising: recycling the removed cleaning solution.

29. A method as claimed in claim 13 wherein the cleaning solution consists essentially of water.

30. A method of cleaning a fabric-like surface such as carpet, fabric and upholstery, said method comprising:

spraying a fabric-like surface with generally foamless atomized cleaning solution consisting essentially of water to clean the fabric-like surface, the cleaning solution being atomized by passing a mixture of pressurized air and pressurized cleaning solution through nozzle means; and removing the cleaning solution from the fabric-like surface immediately after it is sprayed thereon.

31. A method as claimed in claim 30 wherein the cleaning solution is atomized by continuously mixing pressurized air and pressurized cleaning solution to continuously produce a mixture thereof which is then continuously and immediately directed through nozzle means to atomize the cleaning solution.

32. A system for cleaning a fabric-like surface such as carpet, fabric and upholstery, said system comprising:

intake means for receiving and mixing pressurized air and pressurized cleaning solution to produce a mixture thereof;

nozzle means in communication with said intake means for atomizing the mixture to produce a substantially foamless atomized cleaning solution and for spraying the atomized cleaning solution onto a fabric-like surface to clean the fabric-like surface;

cleaning solution supply means for supplying said intake means with pressurized cleaning solution;

air supply means for supplying said intake means with pressurized air; and vacuum means adjacent said nozzle means for removing the cleaning solution having been sprayed onto the fabric-like surface.

33. A system as claimed in claim 32 wherein said intake means includes a Y connector and wherein said nozzle means includes a spray nozzle.

* * * * *